US006027152A

United States Patent [19]

Sawdey

[11] Patent Number: 6,027,152

[45] Date of Patent: Feb. 22, 2000

[54] ERGONOMIC CARRYING DEVICE

[75] Inventor: David J. Sawdey, Wilmington, Del.

[73] Assignee: E. I. du Pont de Nemours and Company, Wilmington, Del.

[21] Appl. No.: 09/208,209

[22] Filed: Dec. 9, 1998

[51] Int. Cl.[7] ..... B65D 25/28

[52] U.S. Cl. ..... 294/27.1; 294/15; 220/759

[58] Field of Search ..... 294/15, 27.1, 31.2, 294/145; 220/737, 759, 762, 765

[56] References Cited

U.S. PATENT DOCUMENTS

| | | | |
|---|---|---|---|
| 1,693,772 | 12/1928 | Allen | 294/27.1 |
| 2,127,607 | 8/1938 | Levow | 294/27.1 |
| 2,279,442 | 4/1942 | Burns et al. | 294/27.1 |
| 2,842,390 | 7/1958 | Stine | 294/15 |
| 4,688,838 | 8/1987 | Skillman | 294/15 |
| 4,834,438 | 5/1989 | Haidet | 294/31.2 |
| 4,993,767 | 2/1991 | Song | 220/759 |
| 5,482,339 | 1/1996 | Chishko, Jr. | 220/759 |
| 5,501,499 | 3/1996 | Zitka | 294/159 |

*Primary Examiner*—Dean J. Kramer
*Attorney, Agent, or Firm*—Hilmar L. Fricke; Steven C. Benjamin

[57] ABSTRACT

An ergonomic carrying device for transporting containers having: a top crossmember having two ends; a first leg member attached to the top crossmember and depending from the top crossmember, and a second leg member attached to and depending from the top crossmember; a backbrace member attached to the first and second leg members and extending therebetween; a bail hook attached to the crossmember at a point between the two ends of the top crossmember; and at least two handles attached at or near each of the two ends of the top crossmember.

10 Claims, 3 Drawing Sheets

ERGONOMIC CARRYING DEVICE

This invention relates to an ergonomic carrying device for containers and, more particularly, to an ergonomic carrying device enabling safe and convenient manual transport of containers such as buckets and pails.

BACKGROUND OF THE INVENTION

Many materials are sold, stored, and transported in containers such as large pails or buckets such as the standard five-gallon pail. While such pails are typically used for liquid materials such as paint and sealants, the pails can also be used to carry quantities of small hardware such as nails.

These kinds of containers are easily transported in bulk by the use of machinery and pallets. In order to transport a pail to a worksite, however, especially where the worksite is inaccessible to machines, for example, on a roof or a remote worksite, the container must be carried by hand. The containers are typically provided with a wire handle or bail for being carried by hand.

Carrying a container by the bail can be difficult and awkward for one person. The bail must either be held in one hand, forcing the person carrying it to bear all of the weight with the single hand, or it must be lifted by using both hands, requiring that the pail be carried in front of the person, making it difficult to walk. In both circumstances, the difficulty is made worse where the weight of the contents of the pail near or exceed an acceptably safe weight for manual transport. Because of the size of the typical five-gallon pail and the configuration of a standard bail, it is likewise awkward for two people to attempt to carry a single pail using the bail.

The object of the present invention is to provide an ergonomic carrier for containers such as pails, such containers being typified by the standard five-gallon pail used extensively for materials such as paints, sealants, and other liquid or near-liquid materials. The carrier is designed for use by two people and, because it engages the bail of the typical container, its use requires no changes or additions to the container itself.

The carrier of this invention enables two people to conveniently and safely transport a container. The carrier is constructed so as to have handles, and so as to distribute the weight of the container evenly. This allows two people to carry easily and safely a container, particularly a container weighing more than would be safe or convenient for one person to carry. The carrier of this invention is designed to allow two people carrying it to walk, unimpeded by the container or the carrier, but close enough together so as to allow the people using the carrier to navigate corridors, catwalks, stairs, and other spaces.

The carrier of this invention can be easily constructed of lightweight yet strong materials, and supports the container being carried such that the container does not swing. The carrier of this invention can be constructed so that it stands upright ready for use, whether or not a container has been engaged, or can be constructed without supporting members.

Carriers known to the prior art, such as those exemplified by the disclosure of U.S. Pat. No. 5,501,499, require that the container be lifted and inserted onto supporting shelves such that the container engages slots or other supporting members. The carrier of this invention differs in many respects from such carriers, particularly in that the carrier of this invention is designed to enable the users to lift and carry a container without first lifting and positioning the container in the carrier. These and other features of the carrier of this invention distinguish it from carriers already known to the art.

SUMMARY OF THE INVENTION

The carrier of this invention may be summarily described as follows. A top crossmember having two ends is provided, the top crossmember being straight or curved as is desired by the manufacturer. Depending from a point at or near each end of the top crossmember are side members, or legs. The legs are preferably spaced from each other at a distance somewhat greater than the diameter or width of the container to be carried so as to allow the container to fit between the legs. Extending between the two legs is a strut or brace, which functions to keep the container being carried from swinging. The strut can be conveniently referred to as a backbrace because it will typically be behind the container as it is carried. The backbrace may be of virtually any shape, but is preferably shaped to approximate the shape and size of the container to be carried between the legs. In the case of typical five-gallon pails, for example, the backbrace preferably would be curved to approximate the curvature of the side of the pail. The carrier is provided with handles designed to be gripped by the hand. The handles may be attached to, or be integral parts of, the ends of the top crossmember, or may be attached to or integral parts of each leg.

Also depending from the top crossmember is a hook, which is designed to engage the bail of the container to be carried. Such a bail hook is attached to the top crossmember at approximately the middle of the top crossmember, such that the weight of the container, when the bail hook is engaged to the container bail, is evenly distributed between the two handles as the container is carried. In one embodiment of this invention, the bail hook takes the form of a small plate depending vertically from the top crossmember. The bottom edge of the plate is bent or curved upward to form a trough or lip in which the bail of the container to be carried rests. The trough or lip is formed or positioned in the direction away from the backbrace such that the lip can engage the bail of the container as the container is positioned between the legs of the carrier. In a preferred embodiment, the lip or trough of the bail hook is up to several inches long in the direction parallel to the top crossmember in order to reduce any side-to-side movement of the container while it is being carried so as to prevent the container from tilting or slipping side-to-side. The bail hook may be attached to the top crossmember, or constructed as an integral part thereof, in any conventional manner. The bail hook may be attached to the top crossmember by a hinge, although in the preferred embodiment a rigid construction is preferred to help prevent the container from swinging.

In use, the carrier is initially positioned such that the container to be carried is between the legs. The bail is positioned within the lip or trough of the bail hook. When the carrier is lifted by the handles, the lip or trough engages the container bail, lifting the container itself. The container is prevented from swinging side-to-side by the legs and the bail hook, and is prevented from swinging in a forwards and backwards direction by the backbrace. The carrier, particularly with respect to the design of the top crossmember and the handles, is constructed such that the weight of the container is centered between the handles such that the weight of the container is evenly distributed. When the desired location is reached, the carrier is simply lowered, allowing the bail to disengage from the trough or lip of the bail hook.

Thus the carrier of this invention allows two people to approach a container, easily engage, lift, and carry the container to a desired location, and conveniently disengage the carrier from the container. The weight of the container is evenly distributed between the handles, and the container is carried without undue swinging.

In one embodiment of this invention, the legs of the carrier may be provided with supports, or feet, at the lowest end of each such that the carrier stands upright when empty or when engaged to the bail of a container. The backbrace may also be positioned along the vertical length of the legs to provide additional support enabling the carrier to stand, empty or loaded. Alternatively, it may be desired to keep the legs of the carrier short enough so that the lower ends of the legs are well clear of the ground when the carrier has a container and, even with such relatively shorter legs, the lower ends of the legs may be provided with supports or feet enabling the carrier to stand upright when empty.

DETAILED DESCRIPTION

The drawings show that the carrying device of this invention is of relatively simple, and therefore inexpensive, construction. Its dimensions will only slightly exceed those of the containers for which it is manufactured. The device can be made so that it stands upright, that is, is free-standing, whether engaged with a container or not. It can be constructed of durable yet inexpensive and lightweight materials such as aluminum tubing or plastic and, when not in use, occupies little storage space.

The carrying device of this invention has only a few essential structural elements. As depicted in one preferred embodiment shown in FIG. 1, there is a top crossmember 10, which can be formed of a section of a straight aluminum tube, for example. Crossmember 10 can take other shapes, depending on the material used and the weight that is expected to be carried. Crossmember 10 could also, for example, be formed from a section of heavy-duty plastic pipe. The length of crossmember 10 should be somewhat greater than the length of the greatest diameter or width of the containers for which the carrying device is to be used.

Figure 1:
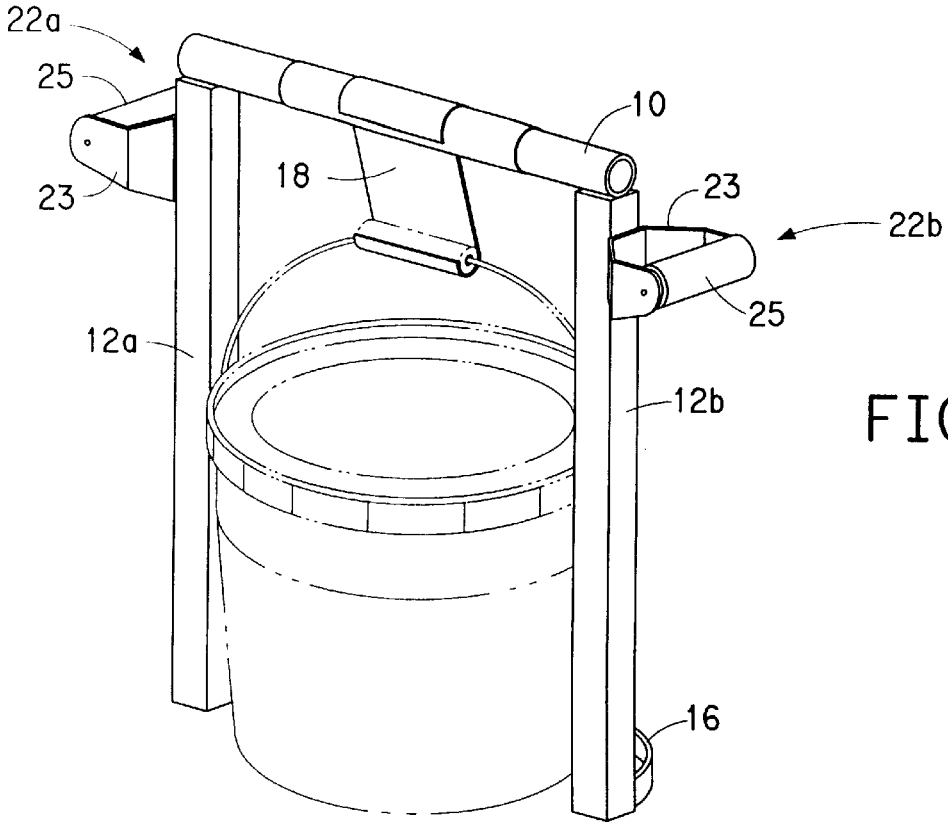
FIG. 1 is a front perspective view of a preferred embodiment of the carrier of this invention, showing the top crossmember, the two legs, the bail hook, the handles, and the backbrace, and showing in dashed lines a container engaged therein.

FIG. 1 also shows the legs 12*a* and 12*b*, which are attached to and depend from crossmember 10. As illustrated in FIG. 1, the legs can also be made of lengths of aluminum tubing and are preferably equal to each other in length. The legs 12*a* and 12*b* are firmly attached to crossmember 10 as by welding or by the use of bolts.

Legs 12*a* and 12*b* are attached to crossmember 10 at or near the respective ends of crossmember 10. If the legs are attached near but not at the very ends of crossmember 10, the distance from the respective ends of crossmember 10 to the points of attachment should be equal. This symmetrical construction helps to ensure that the carrying device itself, and the load it carries when engaged to a container, are balanced.

Legs 12*a* and 12*b* can be of any desired length. In the preferred embodiment shown in FIG. 1, the lengths are shown as being equal to each other to keep the carrying device balanced. In the preferred embodiment illustrated in FIG. 4, the bottom of each leg 12*a* and 12*b* has a plate or short strut attached to serve as feet 14*a* and 14*b*, respectively. Feet 14*a* and 14*b* enable the carrying device to be free-standing.

Legs 12*a* and 12*b* should be attached to crossmember 10 such that the containers for which the carrying device is intended will fit easily in between them. That is, the distance between the inner surfaces or edges of legs 12*a* and 12*b* should be slightly longer than the length of the widest diameter or width of the intended containers. In the preferred embodiments of the carrying device of this invention, the clearance between each leg and the respective side of the containers is large enough to ensure that the carrying device can be easily engaged to a container, and small enough to minimize any side-to-side swinging of the container as it is being carried.

Figure 2:
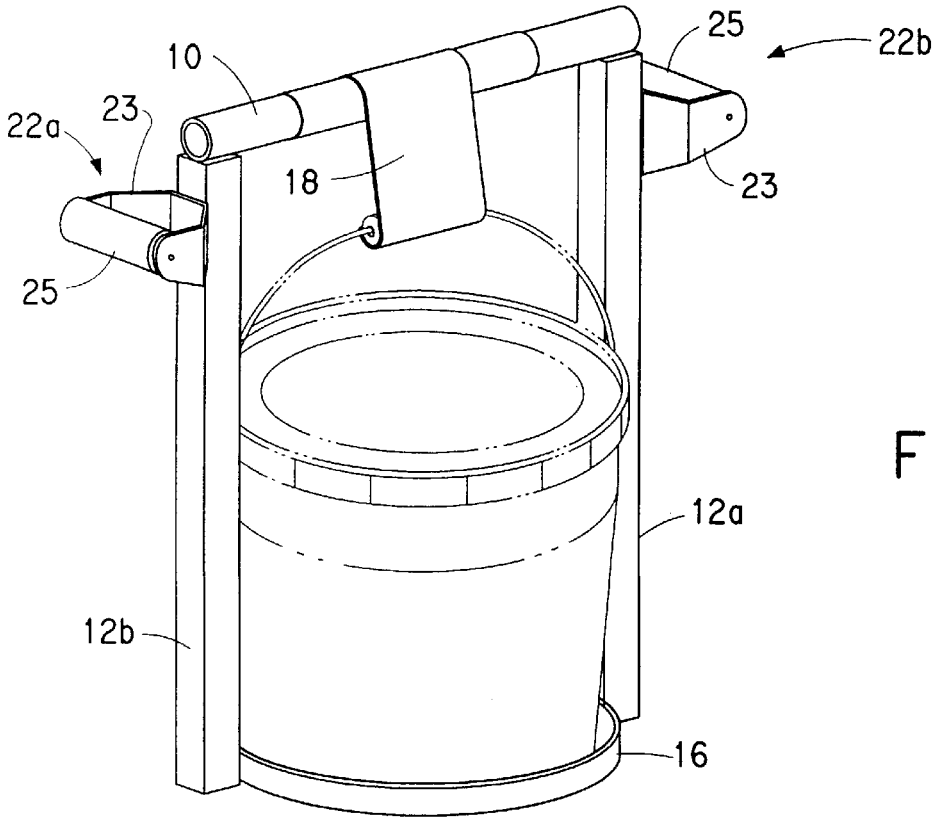
FIG. 2 is a top perspective view of the carrier of FIG. 1, particularly illustrating the arrangement of the backbrace, again showing in dashed lines a container engaged in the carrier.

A backbrace 16, shown in FIG. 1 and FIG. 2, is attached to legs 12*a* and 12*b*. Backbrace 16, as shown in these figures, can be made of a formed or molded strip which is attached at each end to legs 12*a* and 12*b* by screws, bolts, or by welding. In the preferred embodiments shown in the drawings, backbrace 16 is shaped to approximate the outer shape and dimensions of the containers for which the carrying device is intended. In the case of five-gallon buckets or the like, for example, backbrace 16 is shaped in the form of an arc which approximates the curvature of the bucket. While the shape of backbrace 16 approximates a portion of the container, however, it is preferred that the shape of backbrace 16 be somewhat larger or flatter than the corresponding shape of the container. In this way, it is easy to engage the container with the carrying device.

Backbrace 16 is intended to extend on only one side, the "back" side, of the carrying device. With backbrace 16 in this position, it is possible to engage a container from the front of the carrying device. Backbrace 16 then serves to reduce or eliminate any back-and-forth swinging of the container while it is being carried in the device.

Backbrace 16 also helps make the carrying device of this invention free-standing. In the preferred embodiments shown in FIGS. 1 and 2, backbrace 16 is attached to legs 12*a* and 12*b* at or very near the bottoms of the legs. In this position, it forms an additional support with the ends, or feet 14*a* and 14*b*, of legs 12*a* and 12*b*, so that the carrying device is self-supporting, or free-standing, both when it is engaged with a container and when not in use.

To engage a container with the carrying device of this invention, there is provided a bail hook 18 attached to crossmember 10, most clearly shown in this embodiment in FIG. 1. As used herein, bail is used to refer to the typical wire-like handle found on typical buckets or pails, and can also include any similar lifting attachment, such as twine or wire attached to a container and used to lift and carry containers such as boxes or packages. Bail hook 18 is designed to releasably engage the bail of a container such that when crossmember 10 is lifted, the container to which the bail is attached is also lifted.

Figure 3A:
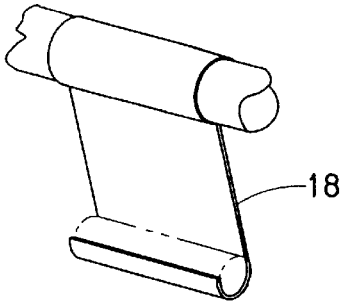
FIGS. 3*a* and 3*b* illustrate two of the possible configurations of the bail hook of a carrier of this invention, the bail of the container being shown in dashed lines.

As shown in FIG. 1, bail hook 18 can take the shape of a simple plate. The plate is attached at or near the center of crossmember 10, and the bottom edge of the plate, as more clearly shown in FIG. 3*a*, is angled or curved upward such that the bail is engaged within the lip or trough formed by the angle or curve. Preferably, the curve of the lip is deep enough to allow the entire diameter of the bail to be engaged completely within the lip, such that the bail does not inadvertently slip out while the container is being carried. Also preferably, the curve of the lip faces away from the back of the carrying device as defined by the location of backbrace 16.

Figure 3B:
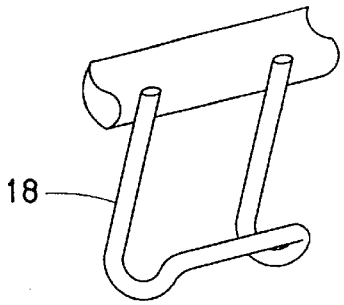

A bail hook 18 in the shape of a plate as shown in FIG. 3*a* can be made, for example, of aluminum or other lightweight metal. Alternatively, as shown in FIG. 3*b*, the bail hook 18 can be made of a heavy gauge wire which has been curved and bent to enable it to engage the bail of a container. While bail hook 18 could also take the shape of a simple hook, embodiments such as those shown in FIGS. 3*a* and 3*b* are preferred because they engage a longer portion of the bail. This ensures not only that the bail is firmly engaged by bail hook 18, but also serves to restrain any side-to-side swinging or sliding of the container while it is being carried.

Bail hook 18 is attached to crossmember 10 at or near the middle of the crossmember, such that the weight of the engaged container is evenly distributed. Bail hook 18 can be rigidly attached to crossmember 10, or can be attached by a hinge or the like. However the bail hook 18 is attached to crossmember 10, it is preferred that the attachment allow no sliding along crossmember 10, as this will allow the load to become unbalanced.

Also shown in FIGS. 1 and 2 are handles 22*a* and 22*b* at or near each respective end of crossmember 10. The handles can be attached to either crossmember 10 itself or to the upper portions of legs 12*a* and 12*b*. The handles can take any configuration which allows easy grasping and lifting by hand. As depicted in FIG. 1, each handle 22*a* or 22*b* can be formed of an angled or curved flange 23 which is attached by bolting, welding, or the like to the top of a leg or to the end of crossmember 10. A rod or bar 25 is attached to the ends of the flange to form the handle. Both the flange and the rod can be made of aluminum or other lightweight metal, and rod 25 can be padded if desired. Each handle should be configured so as to make it convenient for two people, one at each side of the carrying device, to reach down, grasp a handle, and lift and transport the carrying device and container engaged therewith.

Figure 4:
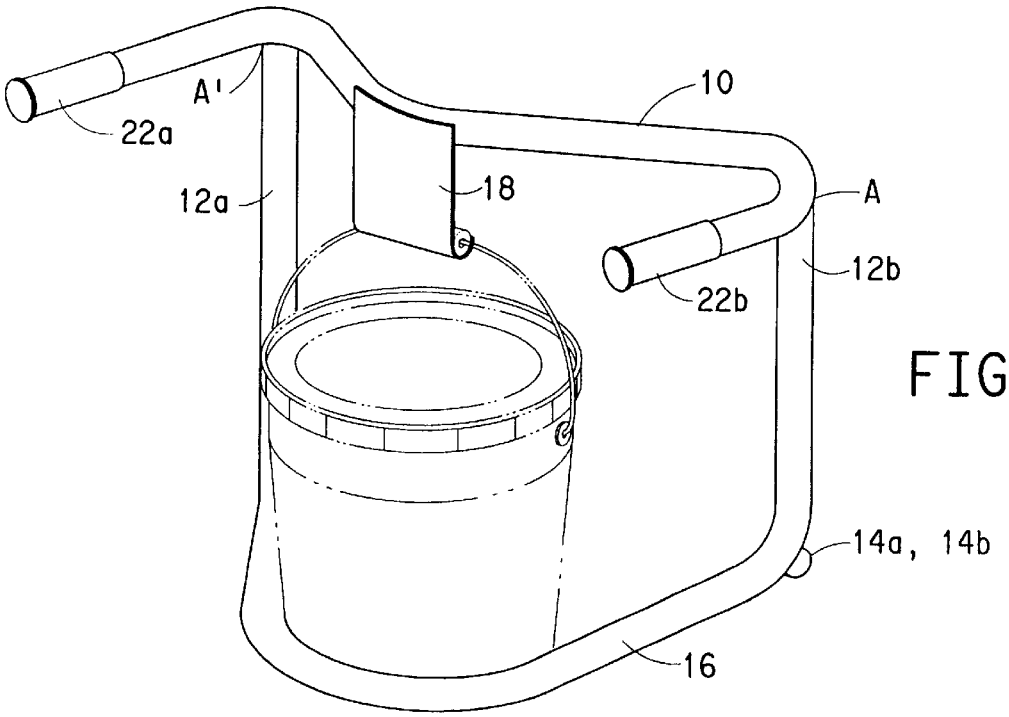
FIG. 4 is a front perspective view of another preferred embodiment of the carrier of this invention, showing a curved top crossmember with integral handles at each end of the crossmember, and with the legs and backbrace positioned and dimensioned so as to enable the carrier to stand upright.

FIG. 4 shows a second preferred embodiment of the carrying device of this invention. For ease of reference, the main elements of the illustrated carrying device have been numbered as in FIGS. 1 and 2. In this embodiment, crossmember 10 has a recurved configuration, similar to the shape of a typical bicycle handlebar. A crossmember of this shape can conveniently be made by bending a length of aluminum tubing to the desired shape. Legs 12*a* and 12*b* are attached as shown at points A and A', near but not at the ends of crossmember 10. At the bottom end of each of legs 12*a* and 12*b* are attached feet 14*a* and 14*b* as described above. As described above, it is preferred that legs 12*a* and 12*b* be designed to have a length such that the bottom ends of the legs, or feet 14*a* and 14*b* are approximately level with the bottom of the container for which the carrying device is intended, enabling the carrying device to be free-standing by itself or when engaged with a container.

Backbrace 16, which can be made of a section of aluminum pipe also, is attached at or near the lower ends of legs 12*a* and 12*b* by welding or bolting, and should be curved or shaped as described above.

Bail hook 18 is attached at about the midpoint of crossmember 10. Bail hook 18 preferably is constructed as shown in FIGS. 3*a* or 3*b*, and is placed such that the load of the container will be evenly balanced and distributed.

Figure 5:
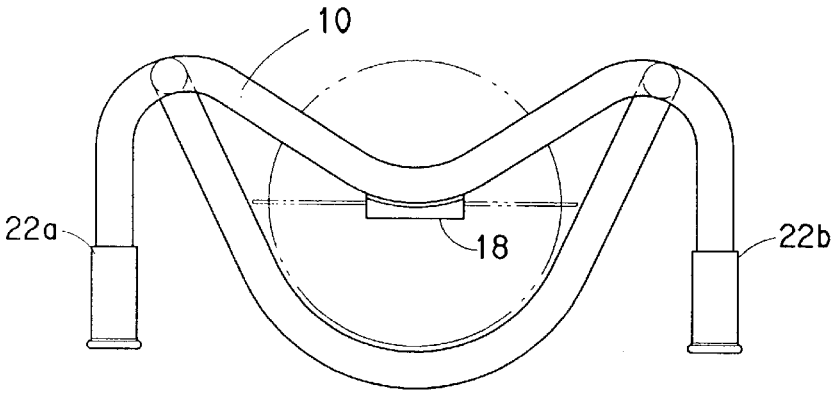
FIG. 5 is a top plan view of the carrier of FIG. 4.

In the second preferred embodiment shown in FIGS. 4 and 5, handles 22*a* and 22*b* are integral parts of crossmember 10. The handles can be simply the ends of the crossmember 10 itself, appropriately padded if desired, or can be separate pieces attached to the ends of the crossmember. In the second preferred embodiment shown in FIGS. 4 and 5, the portions of crossmember 10 that form handles 22*a* and 22*b* are perpendicular to the side-to-side length of the crossmember, that is, approximately parallel to the direction of travel when the carrying device is used to carry a container. This configuration of the handles makes it convenient for the people carrying the device to grasp the handles without any twisting of the arm or wrist.

As in the case of the preferred embodiment shown in FIGS. 1 and 2, crossmember 10, legs 12*a* and 12*b*, bail hook 18, and handles 22*a* and 22*b* should be configured so that the weight of a container being carried is evenly distributed side-to-side. In the second preferred embodiment, the placement of the handles and the shape of crossmember 10 should be designed to ensure an even distribution in the back-and-front direction. That is, viewed in the horizontal plane of crossmember 10, the location of the bail hook 18 should not be too far ahead or behind the location of the handles. This would tend to force the crossmember to tilt out of the horizontal plane, making the load more difficult to carry.

Figure 6:
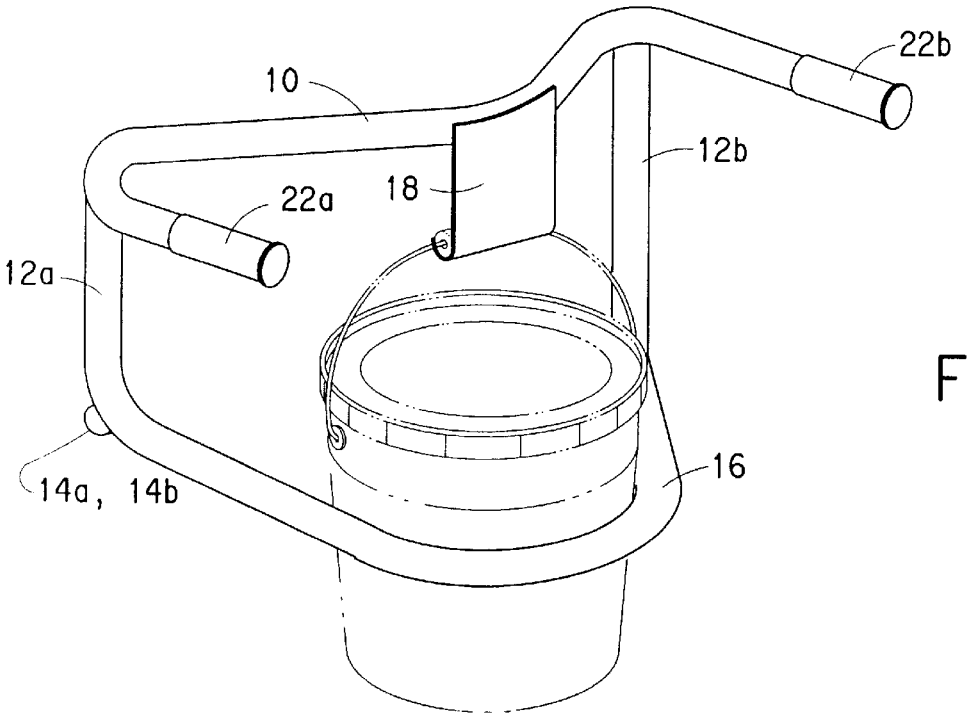
FIG. 6 is a front perspective view of another preferred embodiment of the carrier of this invention similar to that shown in FIG. 4, with the legs and backbrace positioned and dimensioned such that the carrier can stand upright when empty but are completely clear of the ground when a container is engaged, a container engaged with the carrier being shown in dashed lines.

FIG. 6 illustrates a variation of the preferred embodiment shown in FIGS. 4 and 5. In this variation, legs 12*a* and 12*b* are designed to have lengths which do not extend to about the bottom edge of the container. A carrying device of this configuration will be free-standing when not in use. When engaged with a container, however, the feet 14*a* and 14*b* will be completely clear of the ground. A carrying device of this configuration, while unable to be free-standing while engaged with a container, may be useful where relatively lighter weight or lower manufacturing costs are factors. Also, because of its relatively lower height when not in use, the carrying device depicted in FIG. 6 may be more convenient to store.

In use, a person on each side of the carrying device grasps the handle on that side. The device is then placed such that the legs are on either side of the container to be engaged. Depending on the height of the container and the lengths of legs 12*a* and 12*b*, the carrying device may be slid into place or simply tilted slightly such that the bail hook 18 engages the bail of the container. Once the bail hook 18 is engaged, all that is required is to lift the device and the engaged container by the handles. The weight is evenly distributed to the two handles, lightening the load each person is carrying. A single container may be so heavy as to exceed the weight that a single person can carry, either as a matter of convenience or indeed as a matter of safety. Use of the carrying device of this invention not only evenly distributes such a load between two people, thus bringing the weight each person carries well within the limits dictated by safety or convenience, but also avoids the discomfort of carrying the container by a typical bail. Moreover, because the side-to-side length of the preferred embodiments of the carrying device of this invention only slightly exceeds the dimension of the container, a container may be conveniently transported to remote worksites through corridors, along sidewalks, or up and down stairways. The light weight and comfortable handling of the carrying device make it useful even where the container is not excessively heavy, or where the distance the container is to be transported is not great.

Because of its relatively simple design and few structural elements, and because of the wide variety of containers for which the device may be useful, many variations to the preferred embodiments shown and described are possible within the scope of this invention. For example, the configuration of the crossmember 10 may vary depending on the container for which the device is designed and the materials from which the device is made. Likewise, the precise shape of bail hook 18 may, and likely should, depend on the type and shape of the bail of the containers for which it is designed. Other variations may be introduced depending on the materials used to construct the device. As described above, the device can conveniently be made out of relatively lightweight materials such as aluminum or plastic tubing or sheeting, but other materials such as wood may be used depending on the material strength needed to bear the load of the containers.

What is claimed is:

1. An ergonomic carrying device for transporting a container comprising:

a top crossmember having two ends;

a first leg member attached to said top crossmember and depending from said top crossmember at or near one of said two ends of said crossmember, and a second leg member attached to said top crossmember and depending from said top crossmember at or near the other of said two ends of said top crossmember, each of said first and second leg members having lower ends;

a backbrace member attached to said first and second leg members and extending there between;

a bail hook attached to said crossmember at a point between said two ends of said top crossmember; and at least two handles attached at or near each of said two ends of said top crossmember;

wherein the top crossmember, the first leg member, the second leg member, the backbrace member define a frontal opening in said device wherein the container being transported is positioned.

2. The ergonomic carrying device of claim 1, wherein said lower ends of each of said first and second leg members have foot members such that said carrying device is supported upright in a free-standing manner by such foot members.

3. The ergonomic carrying device of claim 2, wherein each of said first and second leg members are of sufficient length that said device is supported upright in a free-standing when said device is engaged with a container.

4. The ergonomic carrying device of claim 2 or claim 3, wherein it least a portion of said backbrace is coplanar in a horizontal plane with said foot members such that said carrying device is supported upright in a free-standing manner by said portion of said backbrace and said foot members.

5. The ergonomic carrying device of claim 1, in which said at least two handles are integral parts of said top crossmember.

6. A combination of an ergonomic carrying device and a container comprising:

a container having a bail;

a top crossmember having a first end and a second end;

a first leg member attached at or near said first end of said crossmember and depending vertically therefrom, said first leg member terminating at the lower end thereof in a foot member;

a second leg member attached at or near said second end of said crossmember and depending vertically therefrom, said second leg member terminating at the lower end thereof in a foot member;

a bail hook attached to said crossmember at a point between said first and second ends of said crossmember, said bail hook being capable of releasably engaging said bail of said container;

a backbrace member extending from a point on said first leg member to a point on said second leg member;

wherein the top crossmember, the first leg member, the second leg member, the backbrace member define a frontal opening in said device wherein the container being transported is positioned; and a first handle attached at or near said first end of said crossmember, and a second handle attached at or near said second end of said crossmember, said first and second handles enabling said device and said container to be lifted and transported by hand.

7. The ergonomic carrying device of claim 6 wherein said first and second legs are vertically dimensioned such that said device and said container are supported in a free-standing manner when not being transported.

8. The ergonomic carrying device of claim 7 wherein at least one portion of said backbrace is coplanar with said foot members such that said device and said container are supported in a free-standing manner by said portion of said backbrace and said foot members.

9. The ergonomic carrying device of claim 6 wherein said crossmember has a recurved configuration in a horizontal plane.

10. The ergonomic carrying device of claim 9 wherein said first and second handles are integrally formed at said first and second ends, respectively, of said crossmember.

* * * * *

UNITED STATES PATENT AND TRADEMARK OFFICE

CERTIFICATE OF CORRECTION

PATENT NO. : 6,027,152
DATED : February 22, 2000
INVENTOR(S) : David J. Sawdey

It is certified that error appears in the above-identified patent and that said Letters Patent is hereby corrected as shown below:

Title page,
Item [57] ABSTRACT, delete "and depending from"

Column 8,
Line 4, delete "it least" and replace with -- at least --

Signed and Sealed this

Eighth Day of January, 2002

*Attest:*

*Attesting Officer*

JAMES E. ROGAN
*Director of the United States Patent and Trademark Office*